United States Patent [19]

Sung

[11] 4,282,008

[45] Aug. 4, 1981

[54] NOVEL FUEL COMPOSITION CONTAINING ALCOHOL

[75] Inventor: Rodney L. Sung, Fishkill, N.Y.

[73] Assignee: Texaco Inc., White Plains, N.Y.

[21] Appl. No.: 189,529

[22] Filed: Sep. 22, 1980

[51] Int. Cl.[3] ..... C10L 1/18; C10L 1/22

[52] U.S. Cl. ....., 44/53; 44/56; 44/63; 252/390; 252/394; 548/255; 548/268

[58] Field of Search ..... 44/53, 56, 63; 252/390, 252/394; 548/255, 268

[56] References Cited

U.S. PATENT DOCUMENTS

| | | | |
|---|---|---|---|
| 3,663,436 | 5/1972 | Carswell | 252/390 |
| 3,907,517 | 9/1975 | Minagawa et al. | 44/63 |
| 3,997,551 | 12/1976 | Minagawa et al. | 548/268 |

*Primary Examiner*—Winston A. Douglas
*Assistant Examiner*—J. V. Howard
*Attorney, Agent, or Firm*—Carl G. Ries; Robert A. Kulason; Carl G. Seutter

[57] ABSTRACT

A novel fuel composition contains ethanol or gasohol plus, as a corrosion inhibitor, a reaction product of an aminotriazole, isatoic anhydride and an N-alkyl propylene diamine.

28 Claims, No Drawings

NOVEL FUEL COMPOSITION CONTAINING ALCOHOL

FIELD OF THE INVENTION

This invention relates to a fuel composition for internal combustion engines particularly characterized by corrosion inhibition.

BACKGROUND OF THE INVENTION

As is well known to those skilled in the art, fuel compositions typified by gasohol and alcohols which are to be considered for commercial use must possess low corrosion activity; and this may be effected by addition thereto of various corrosion inhibition systems. It is an object of this invention to provide a fuel composition for internal combustion engines particularly characterized by corrosion inhibition. Other objects will be apparent to those skilled in the art.

STATEMENT OF THE INVENTION

In accordance with certain of its aspects, the fuel composition of this invention may comprise (a) a major portion of a fuel containing (i) at least one alcohol selected from the group consisting of ethanol and methanol and (ii) gasoline in amount of 0–50 volumes per volume of alcohol; and (b) a minor corrosion inhibiting amount of, as a corrosion inhibiting agent, a reaction product of (i) an aminotriazole, (ii) an isatoic anhydride, and (iii) a $C_3$–$C_{12}$ poly-primary amine bearing at least one free —$NH_2$ group and at least one —NHR′ group wherein R′ is a $C_{12}$–$C_{18}$ hydrocarbon group.

DESCRIPTION OF THE INVENTION

The fuel for internal combustion engines which may be treated by the process of this invention may contain (i) at least one alcohol selected from the group consisting of ethanol and methanol and (ii) gasoline in amount of 0–50 volumes per volume of alcohol. The fuel may be an alcohol-type fuel containing little or no hydrocarbon. Typical of such fuels are methanol, ethanol, mixtures of methanol-ethanol, etc. Commercially available mixtures may be employed. Illustrative of one such commercially available mixture may be that having the following typical analysis;

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may be formed by mixing 90–95 volumes of gasoline with 5–10 volumes of ethanol or methanol. A typical gasohol may contain 90 volumes of gasoline and 10 volumes of absolute alcohol.

It is preferred that the fuels to be treated by the process of this invention be substantially anhydrous i.e. that they contain less than about 0.3 v % water; typically they may contain 0.01 v %–0.005 v %, say about 0.004 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the fuel a minor corrosion inhibiting amount of, as a corrosion inhibiting agent, a reaction product of (i) an aminotriazole, (ii) an isatoic anhydride, and (iii) a $C_3$–$C_{12}$ poly-primary amine bearing at least one free —$NH_2$ group and at least one —NHR′ group wherein R′ is a $C_{12}$–$C_{18}$ hydrocarbon group.

The aminotriazole which may be employed include 5-amino-1,2,3-triazoles, 4-amino-1,2,4-triazoles, 3-amino-1,2,4-triazoles, and 5-amino-1,2,4-triazoles, including those bearing inert substituents, typified by hydrocarbon or alkoxy groups, which do not react in the instant reaction. Illustrative of the aminotriazoles may be:

TABLE 4-methyl-5-amino-1,2,3-triazole
4-ethyl-5-amino-1,2,3-triazole
4-n-propyl-5-amino-1,2,3-triazole
4-methoxy-5-amino-1,2,3-triazole
-cyclohexyl-5-amino-1,2,3-triazole
4-phenyl-5-amino-1,2,3-triazole
1-methyl-5-amino-1,2,3-triazole
1-ethyl-5-amino-1,2,3-triazole
1-n-propyl-5-amino-1,2,3-triazole
1-methoxy-5-amino-1,2,3-triazole
1-cyclohexoxy-5-amino-1,2,3-triazole
1-phenyl-5-amino-1,2,3-triazole
3-methyl-5-amino-1,2,4-triazole
3-ethyl-5-amino-1,2,4-triazole
3-n-propyl-5-amino-1,2,4-triazole
3-methoxy-5-amino-1,2,4-triazole
3-cyclohexoxy-5-amino-1,2,4-triazole
3-phenyl-5-amino-1,2,4-triazole
1-ethyl-5-amino-1,2,4-triazole
1-ethyl-5-amino-1,2,4-triazole
1-n-propyl-5-amino-1,2,4-triazole
1-methoxy-5-amino-1,2,4-triazole
1-cyclohexoxy-5-amino-1,2,4-triazole
1-phenyl-5-amino-1,2,4-triazole The preferred triazole may be 5-amino-1,2,4-triazole.

The isotoic anhydride which may be employed in practice of the process of this invention may be characterized by the formula:

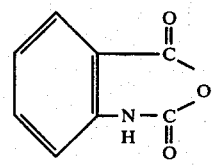

This charge material may bear inert substituents (which do not interfere with the reaction) on the nitrogen atom or on the ring. Typical of these may be alkyl, aralkyl, alkaryl, aryl, or cycloalkyl hydrocarbon substituents.

The ring may also bear other inert substituents typified by alkoxy, aryloxy, etc.

The preferred isatoic anhydride is isatoic anhydride se.

The amines which may be employed include polyamines, preferably diamines, which bear at least one free primary amine —$NH_2$ group and at least one substituted primary amine group. The latter may be di-substituted, but more preferably it is mono-substituted. The hydrocarbon nucleus of the amine may be aliphatic or aromatic-including alkyl, alkaryl, aralkyl, aryl, or cyclalkyl in nature. The preferred amines may be of the formula $$R'NH—R''—NH_2$$

i.e. monosubstituted diprimary imines. In the preferred diamines (preferably N-alkyl alkylene diamines), the R'' group may be alkylene, aralkylene, alkarylene, arylene, or cycloalkylene. R'' may possess 2–6 carbon atoms. The R' group may be a $C_{12}$–$C_{18}$ alkyl, alkaryl, aralkyl, aryl, or cycloalkyl hydrocarbon moiety.

Illustrative of the preferred N-mono-alkyl alkylene diamines may include:

A. The Duomeen O brand of N-mono-oleoyl-1,3-propane diamine;

B. The Duomeen S brand of N-mono-stearyl-1,3-propane diamine;

C. The Duomeen T brand of N-mono-tallow-1,3-propane diamine.

D. The Duomeen C brand of N-mono-coco-1,3-propane diamine.

E. The Duomeen L-11 brand of N-beta undecyl-1,3-propane diamine.

The most preferred R'NH-R''-$NH_2$ is that wherein the R'' group is propylene —$CH_2CH_2CH_2$— and the R' group may be a $C_{12}$–$C_{18}$ n-alkyl group. The preferred composition may be R'-N H-$CH_2CH_2CH_2$-$NH_2$ wherein R' is a $C_{12}$ straight chain alkyl group.

It will be apparent to those skilled in the art that the several reactants may bear inert substituents which are typified by alkyl, alkoxy, halogen, nitro, cyano, haloalkyl, etc. It will also be apparent that the preferred compounds to be employed will be those which are soluble in the solvents employed during the reaction and which produce products which are soluble in or compatible with the system in which the product is to be employed.

Typical polar solvents which may be employed may include dimethyl formamide, tetrahydrofuran, dimethyl sulfoxide. A particularly preferred system may include dimethyl formamide.

Formation of the desired additive may preferably be effected by placing substantially equimolar quantities of the isatoic anhydride and the aminotriazole and the amine in a reaction vessel in an excess of solvent. A typical solvent (e.g. dimethyl formamide) may be present in amount of 30–100 volumes, say 70 volumes per 100 volumes of the total of the other reactants. It is not necessary to add catalyst. The reaction mixture may be refluxed at 145° C.–155° C., say 153° C. for 8–24 hours, say 24 hours.

The following reaction may occur (in the case of 5-amino-1,2,4-triazole with isatoic anhydride and N-monoalkyl propylene diamine).

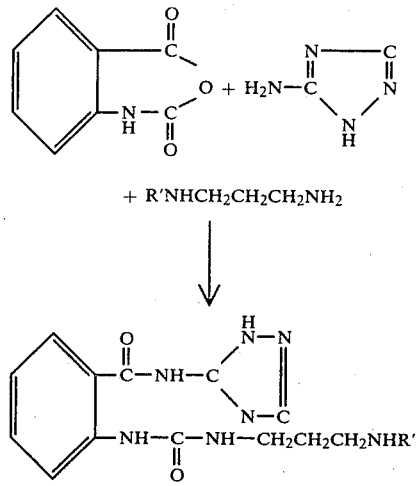

At the end of the reaction period, the reaction mixture may be cooled to ambient temperature of 20° C.–27° C., say 25° C. and filtered and then stripped (as by distillation at 80° C.–100° C., say 120° C.) of solvent.

The residue which is generally a waxy solid or viscous liquid is recovered in yield approaching stoichiometric.

The so-prepared rust and corrosion inhibitor may be added to fuels (including alcohol, gasoline, gasohol etc.) or to antifreeze. These compositions may be particularly found to be effective as rust and corrosion inhibitors when added to absolute alcohol fuels typified by those available commercially containing components including ethers, esters, acids, etc.

The so prepared rust and corrosion inhibitors may be added to a fuel in amount of 0.25–25 PTB, preferably 1–20 PTB, more preferably 1–10 PTB, say 10 PTB. (PTB stands for pounds of additive per thousand barrels of fuel) Alternatively expressed, the inhibitor may be added to a fuel in minor corrosion-inhibiting amount of 0.0001–0.01 w %, preferably 0.0004–0.008 w %, more preferably 0.0004–0.0040 w %, say 0.0040 w %. Larger amounts may be employed but may not be necessary.

It is a feature of this invention that the fuel composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 110 ml of the test liquid in a 4 ounce bottle for 15 minutes at room temperature of 20° C. 20 ml of the test liquid is poured off and replaced with 20 ml of distilled water. The bottle is shaken as the sample is maintained for 3 hours at 90° F. The percent rust on the strip is determined visually. A second reading is taken after 40 hours.

The inhibited fuels of this invention, after 40 hours of ISCT generally show a Rust and Corrosion rating below about 2–3% and frequently as low as trace-to-1%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode known to me of practicing the process of this invention, there are added to a reaction vessel containing 200 parts of dimethyl formamide solvent, equimolar amounts of isatoic anhydride (33 parts), Duomeen T brand of N-mono-tallow-1,3-propane diamine (74.8 parts), and 5-amino-1H-1,2,4-triazole (8 parts).

The reaction mixture is heated to reflux for 24 hours, filtered hot and then stripped of solvent by distillation.

The additive so-prepared (38.4 ppm corresponding to 10 PTB) is added to 96 parts of the anhydrous alcohol composition of Table I and 4 parts of distilled water and the resulting composition was tested in the ISCT to determine the Rust and Corrosion rating after 40 hours.

EXAMPLE II*

*Designates a control example; all others are experimental examples.

The procedure of Example I was duplicated except that the additive was 76 PTB of a commercial rust and corrosion inhibitor and only 3 parts of distilled water is added.

The fuel composition was tested in the ISCT.

EXAMPLE III*

The procedure of Examples I–II was duplicated except that no additive was present—only 4 parts of distilled water.

The results of the Iron Strip Corrosion Test were as follows:

TABLE

| Example | 40 hour Rust & Corrosion Rating |
|---|---|
| I | 0 |
| II* | 25% |
| III* | 50% |

From the above table, it will be apparent that the system of Example I, prepared in accordance with practice of the process of this invention, showed no rust and corrosion. Control Examples II–III showed 25%–50% rust and corrosion which is unsatisfactory.

Results comparable to those of Example I may be obtained when the amine reacted is:

TABLE

| Example | Amine |
|---|---|
| IV | Duomeen O brand of N-mono-oleyl-1,3-propane diamine |
| V | Duomeen S brand of N-mono-stearyl-1,3-propane diamine |
| VI | Duomeen C brand of N-mono-cocoyl-1,3-propane diamine |

Results comparable to those of Example I may be obtained when the isatoic anhydride reactant is:

TABLE

| Example | Reactant |
|---|---|
| VII | 3-methyl isatoic anhydride |
| VIII | 3-ethyl isatoic anhydride |
| IX | 3-propyl isatoic anhydride |
| X | 3-butyl isatoic anhydride |

Results comparable to those of Example I may be obtained when the aminotriazole reactant is:

TABLE

| Example | Aminotriazole |
|---|---|
| XI | 3-amino-1H-1,2,4-triazole |
| XII | 4-amino-4H-1,2,4-triazole |
| XIII | 5-amino-1H-1,2,4-triazole |

Results comparable to those of Example I may be obtained if the fuel is as follows:

TABLE

| Example | Fuel |
|---|---|
| XIV | Gasohol containing 90 v% gasoline and 10 v% absolute ethanol |
| XV | absolute ethanol |
| XVI | absolute methanol |

Although this invention has been illustrated by reference to specific embodiments, it will be apparent to those skilled in the art that various changes and modifications may be made which clearly fall within the scope of this invention.

I claim:

1. A fuel composition for internal combustion engines comprising (a) a major portion of a fuel containing (i) at least one alcohol selected from the group consisting of ethanol and methanol and (ii) gasoline in amount of 0–50 volumes per volume of alcohol; and (b) a minor corrosion inhibition amount of, as a corrosion inhibiting agent, a reaction product of (i) an aminotriazole, (ii) an isatoic anhydride, and (iii) a $C_3$–$C_{12}$ poly-primary amine bearing at least one free —$NH_2$ group and at least one —NHR′ group wherein R′ is a $C_{12}$–$C_{18}$ hydrocarbon group.

2. A fuel composition for internal combustion engines as claimed in claim 1 wherein said fuel is an alcohol.

3. A fuel composition for internal combustion engines as claimed in claim 1 wherein said fuel is methanol.

4. A fuel composition for internal combustion engines as claimed in claim 1 wherein said fuel is ethanol.

5. A fuel composition for internal combustion engines as claimed in claim 1 wherein said fuel is a commercial ethanol.

6. A fuel composition for internal combustion engines as claimed in claim 1 wherein said fuel is a commercial ethanol containing acid.

7. A fuel composition for internal combustion engines as claimed in claim 1 wherein said fuel is a commercial ethanol containing acetic acid.

8. A fuel composition for internal combustion engines as claimed in claim 1 wherein said fuel is a gasohol.

9. A fuel composition for internal combustion engines as claimed in claim 1 wherein said fuel is substantially anhydrous.

10. A fuel composition for internal combustion engines as claimed in claim 1 wherein said fuel contains less than 0.3 v % water.

11. A fuel composition for internal combustion engines as claimed in claim 1 wherein said aminotriazole is 5-amino-1,2,3-triazole.

12. A fuel composition for internal combustion engines as claimed in claim 1 wherein said aminotriazole is 5-amino-1,2,4-triazole.

13. A fuel composition for internal combustion engines as claimed in claim 1 wherein said amine is a diamine.

14. A fuel composition for internal combustion engines as claimed in claim 1 wherein said amine is a diamine containing an —NHR′ group.

15. A fuel composition for internal combustion engines as claimed in claim 1 wherein said amine is R′—NH—R″—$NH_2$, R″ is alkylene, arylene, alkarylene, arylene, or cycloalkylene hydrocarbon and R is $C_{12}$–$C_{18}$ alkyl, alkaryl, aralkyl, aryl, or cycloalkyl hydrocarbon.

16. A fuel composition for internal combustion engines as claimed in claim 1 wherein said amine is R′—NH—$CH_2CH_2CH_2NH_2$ and R′ is $C_{12}$–$C_{18}$ alkyl.

17. A fuel composition for internal combustion engines as claimed in claim 1 wherein said aminotriazole is 5-amino-1,2,3-triazole, said isatoic anhydride is isatoic anhydride se, and said amino is R′$NHCH_2CH_2CH_2NH_2$, and R′ is oleoyl or tallowyl.

18. A fuel composition for internal combustion engines as claimed in claim 1 wherein said corrosion inhibiting agent is present in minor corrosion inhibiting amount of 0.0001 w %–0.005 w % of said fuel composition.

19. A fuel composition for internal combustion engines comprising (a) a major portion of a fuel containing absolute ethanol; and (b) a minor corrosion inhibiting amount, 0.0001 w %–0.005 w % of said fuel composition, of as a corrosion inhibiting agent, a reaction product of 5-amino-1,2,4-triazole, isatoic anhydride and R′$NHCH_2CH_2NH_2$ wherein R′ is a $C_{12}$–$C_{18}$ alkyl hydrocarbon.

20. A composition comprising a reaction product of (i) an aminotriazole, (ii) an isatoic anhydride, and (iii) a $C_3$–$C_{12}$ poly-primary amine bearing at least one free —$NH_2$ group and at least one —NHR′ group wherein R′ is a $C_{12}$–$C_{18}$ hydrocarbon group.

21. A composition as claimed in claim 20 wherein said aminotriazole is 5-amino-1,2,3-triazole.

22. A composition as claimed in claim 20 wherein said aminotriazole is 5-amino-1,2,4-triazole.

23. A composition as claimed in claim 20 wherein said amine is a diamine.

24. A composition as claimed in claim 20 wherein said amine is a diamine containing an —NHR group.

25. A composition as claimed in claim 20 wherein said amine is R′—NH—R″—$NH_2$, R″ is alkylene, arylene, alkarylene, arylene, or cycloalkylene hydrocarbon and R is $C_{12}$–$C_{18}$ alkyl, alkaryl, aralkyl, aryl, or cycloalkyl hydrocarbon.

26. A composition as claimed in claim 20 wherein said amine is R′—NH—$CH_2CH_2CH_2NH_2$ and R′ is $C_{12}$–$C_{18}$ alkyl.

27. A composition as claimed in claim 20 wherein said aminotriazole is 5-amino-1,2,4-triazole, said isatoic anhydride is isatoic anhydride se, and said amine is R′$NHCH_2CH_2CH_2NH_2$, and R′ is oleoyl or tallowyl.

28.

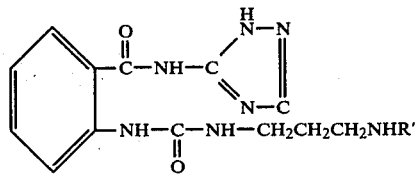

wherein R′ is a $C_{12}$–$C_{18}$ n-alkyl hydrocarbon.

* * * * *

UNITED STATES PATENT AND TRADEMARK OFFICE

CERTIFICATE OF CORRECTION

PATENT NO. : 4,282,008

DATED : August 4, 1981

INVENTOR(S) : R. L. Sung

It is certified that error appears in the above-identified patent and that said Letters Patent are hereby corrected as shown below:

Column 2, line 30, insert "4" before -- -cyclohexyl --;

Column 2, line 46, cancel "ethyl", insert -- methyl --;

Column 7, line 25, cancel "amino", insert -- amine --.

Signed and Sealed this

Tenth Day of November 1981

[SEAL]

Attest:

GERALD J. MOSSINGHOFF

Attesting Officer

Commissioner of Patents and Trademarks